United States Patent [19]

Konta

[11] Patent Number: 4,832,649

[45] Date of Patent: May 23, 1989

[54] DOUBLE DOOR OPENING AND CLOSING MECHANISM FOR USE IN TOYS AND MODELS

[75] Inventor: Ikuo Konta, Tokyo, Japan

[73] Assignee: Tomy Kogyo Co., Inc., Tokyo, Japan

[21] Appl. No.: 118,948

[22] Filed: Nov. 10, 1987

[30] Foreign Application Priority Data

Nov. 11, 1986 [JP] Japan ..... 61-173055[U]

[51] Int. Cl.[4] ..... A63H 33/26

[52] U.S. Cl. ..... 446/135; 446/132; 446/476

[58] Field of Search ..... 446/129, 130, 131, 132, 446/133, 134, 135, 136, 137, 138, 139, 423, 426, 476; 368/126, 272, 273

[56] References Cited

U.S. PATENT DOCUMENTS

| | | | |
|---|---|---|---|
| 355,893 | 8/1885 | Sternberg | 236/88 |
| 2,050,892 | 8/1936 | Marx | 446/423 X |
| 2,135,584 | 11/1938 | Lohr | 446/423 X |
| 2,188,739 | 1/1940 | Müller | 446/423 X |
| 2,480,030 | 8/1949 | Karwacki | 446/423 |
| 2,505,626 | 4/1950 | Palmer | 446/130 |
| 2,549,980 | 4/1951 | Machesney | 446/130 |
| 2,735,222 | 2/1956 | Glass | 446/461 |
| 3,867,786 | 2/1975 | Greenblatt | 446/130 |
| 3,918,249 | 11/1975 | Masuyama | 368/272 |
| 3,961,440 | 6/1976 | Saito | 446/464 |
| 4,091,561 | 5/1978 | Kimura | 446/137 |

FOREIGN PATENT DOCUMENTS

| | | |
|---|---|---|
| 670854 | of 0000 | Fed. Rep. of Germany . |
| DE 3611503 A1 | of 0000 | Fed. Rep. of Germany . |
| 2211468 | 3/1972 | Fed. Rep. of Germany . |
| 1106398 | 12/1955 | France . |
| 56-4066 | 1/1980 | Japan . |
| 60-9815 | 1/1982 | Japan . |
| 62-14874 | 10/1983 | Japan . |
| 61-25518 | 2/1984 | Japan . |
| 62-13839 | 8/1984 | Japan . |
| 2077117A | 12/1981 | United Kingdom . |

*Primary Examiner*—Robert A. Hafer
*Assistant Examiner*—Sam Rimell
*Attorney, Agent, or Firm*—Staas & Halsey

[57] ABSTRACT

An opening and closing device for double doors for use in a toy, including: a base plate mounted with a housing formed with two openings and including two adjacent elongated holes; a pair of rotary plates receiving the lower ends of the doors; a spring normally biased the doors closed; a rotary lever engageable with edges of the rotary plates and provided with a magnet and an integral gear loosely fitted with and supported by a support shaft; and an operating lever, including a first end projecting from an opening formed at the side of the base plate, pivoted at its center portion and formed at a second end thereof with an arc-shaped edge including a rack engageable with the gear. When a separate doll including a magnetic substance is placed on the base plate over the rotary lever, the lever is moved upwardly and the gear engages the rack, whereupon the doors can be opened by the operating lever. When the doll is not so placed, the operating lever cannot operate the doors.

8 Claims, 8 Drawing Sheets

DOUBLE DOOR OPENING AND CLOSING MECHANISM FOR USE IN TOYS AND MODELS

BACKGROUND OF THE INVENTION

The present invention relates to a manually operated, opening and closing, mechanism for double doors suitable for use in a toy or model.

There have been known a number of devices, wherein a door used in a toy or model can be opened and closed by operating an operating lever or a switch.

In the conventional door opening and closing mechanism used in, e.g., a model space station airlock, etc., when a single door is opened and closed, the imaginary air-tightness in the space station cannot be maintained. This leads to an undesirable lack of realism during play.

SUMMARY OF THE INVENTION

The present invention solves the foregoing problem. A base plate, which is an upper plate of a base, receives a housing formed with entrance-and-exit openings, each receiving a door, and is formed near the openings with elongated holes through which lower ends of the doors pass. Under the base plate is arranged a pair of rotary plates inside the base. The rotary plates are fitted with the lower ends of the doors passing through the elongated holes. A spring extends between and is mounted to the rotary plates and normally biases them closed. A rotary lever, which is engageable with edges of the rotary plates, is provided with a magnetic substance such as a permanent magnet or an iron piece at the upper side of its tip, and is integrally formed with a gear at its base end. This gear is loosely fitted with and supported by a support shaft with a predetermined space therebetween and the tip of the rotary lever is vertically movable. An operating lever projecting from an opening formed at the side of the base plate is pivoted at its center portion and is formed with an arc-shaped edge having a rack engageable with the gear integrally formed with the rotary lever. The tip of the rotary lever is attracted by the permanent magnet incorporated at the lower portion of a doll to move upward.

When the doll is not placed outside the door, the rotary lever is lowered by its own weight and the gear integrally formed therewith is spaced apart from the rack so that the doors cannot be opened and closed, even by operating the operating lever. On the other hand, when the doll is disposed on the base plate outside the door, the tip of the rotary lever moves upward by the attracting force of the permanent magnet incorporated in the doll and the gear integrally formed with the rotary lever engages the rack of the operating lever to rotate the rotary lever. When the tip of the rotary lever engages one of the rotary plates to rotate same, the first door is opened and the doll, being attracted by the magnetic substance provided at the tip of the rotary lever, slides on the base plate and is advanced to the inside of the door. When the doll reaches the inside of the first door, the first door is closed so that the space isolated by the first and second doors presents a seemingly airtight condition. By further continuing the operation of the operating lever, the other rotary plate is rotated to open the second door so that the doll can enter the station. When the doll passes the second door, the second door is closed.

DETAILED DESCRIPTION OF THE PREFERRED EMBODIMENTS

Figure 1:
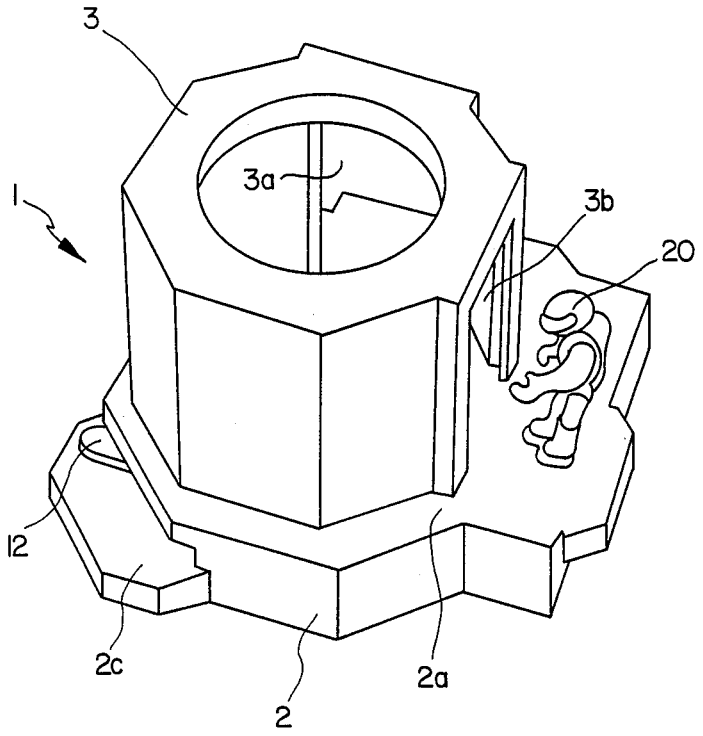
FIG. 1 is a perspective view of the housing and base.
Figure 2:
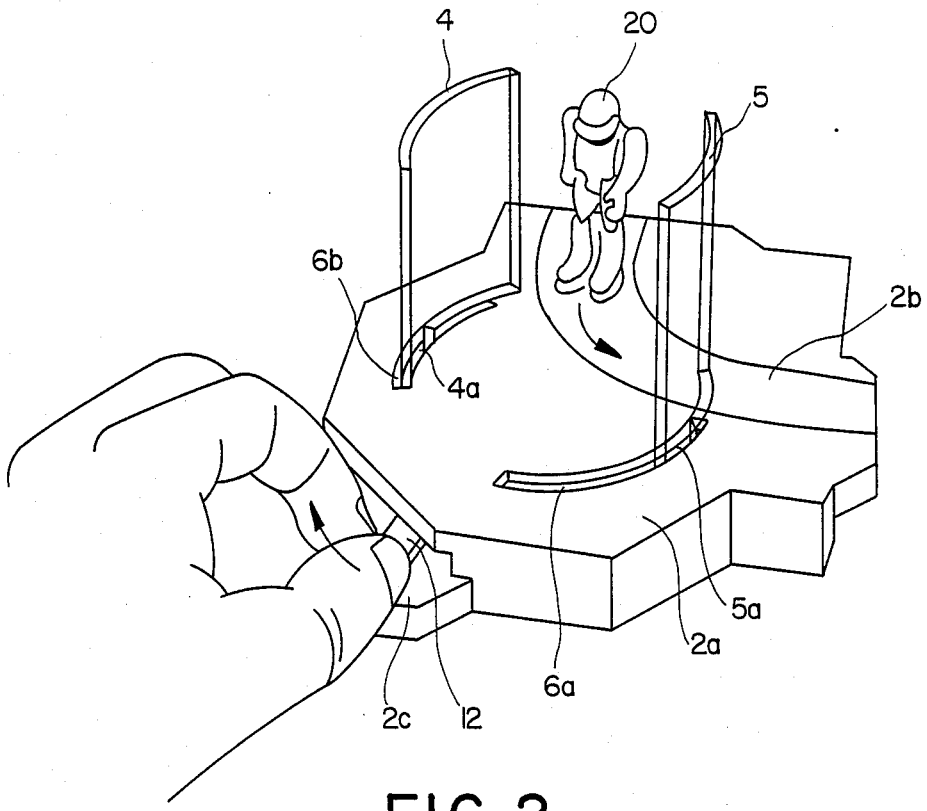
FIG. 2 is a perspective view of the base with the housing removed.

As shown in FIGS. 1 and 2, a body 1 is constituted by mounting a barrel-shaped shell or housing 3 on a base plate 2*a* which is an upper plate of base 2. The shell 3 is formed with openings 3*a*, 3*b* at the sides thereof for a doll 20 to enter and exit the housing 3. Two doors 4, 5 are provided for opening and closing the openings 3*a*, 3*b*. The first door 4 is arranged inwardly of the opening 3*a* and the second door 5 is arranged inwardly of the opening 3*b*. An operating lever 12 projecting from an opening formed at the side of the base 2 is placed on a projection 2*c* provided at the side of the base 2 and is rotatable right and left.

The first and second doors 4, 5 are respectively arched inwardly and made of transparent materials through which the inside of the housing can be seen. The first door 4 is provided at its lower end with a projection 4*a* which passes through an elongated hole 6*b* of an arc-shape formed on the base plate 2*a*. A projection 5*a* of the second door 5 passes through an elongated hole 6*a* of an arc-shape formed on the base plate 2*a*. The reference number 2*b* denotes a passage on which the doll 20 slides.

Figure 3:
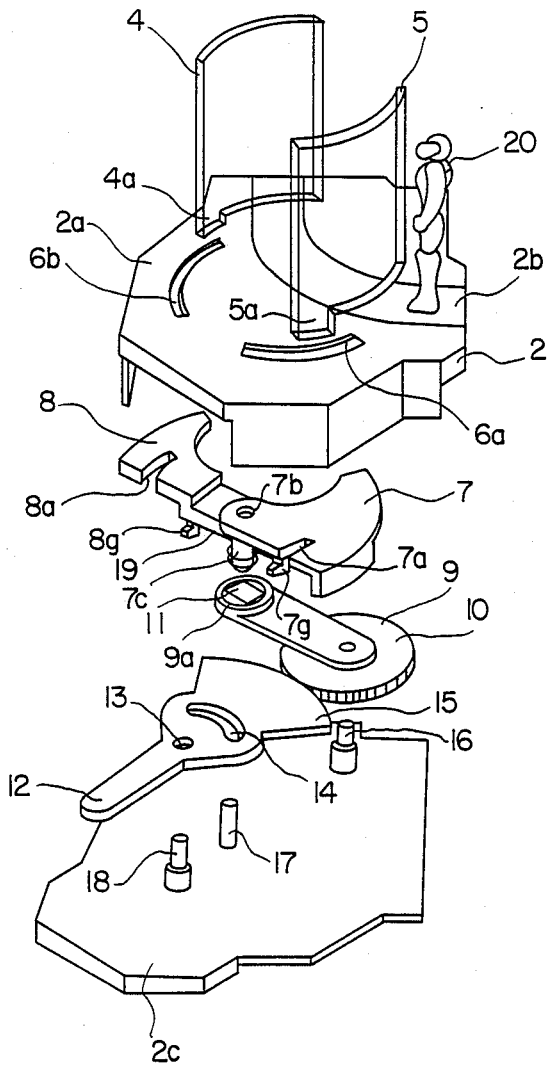
FIG. 3 is an exploded perspective view of the housing and base.

As best seen in FIG. 3, under the base plate 2*a*, a pair of rotary plates 7, 8 are rotatably supported at hole 7*b* by a support shaft 17 inside the base 2. The rotary plates 7, 8 are respectively formed with openings 7*a*, 8*a*. The projection 5*a* of the second door 5 fits in the opening 7*a* and the projection 4*a* of the first door 4 fits in the opening 8*a*. A coil spring 19 is wound onto a boss 7*c* projecting from the rotary plate 7 and is fixed at both ends to projections 7*g*, 8*g* provided on the rotary plates 7, 8, respectively. The coil spring 19 normally biases the rotary plates 7, 8 to close the first and second doors 4, 5.

Below the rotary plates 7, 8 is arranged a rotary lever 9. The rotary lever 9 is integrally formed with a gear 10 at its base end and a support shaft 16 is loosely fitted in a relatively large bearing hole 10*a* of the gear 10. The rotary lever 9 is formed with a cylindrical portion 9*a* at one end receiving on an upper portion a magnetic substance 11, such as permanent magnets or iron pieces. The outer periphery of the cylindrical portion 9*a* is engageable with the edges of the rotary plates 7, 8 and functions to rotate the rotary plates 7, 8 against the elastic force of the coil spring 19.

The operating lever 12 is rotatably supported by a support shaft 18 at a bearing hole 13 formed at an intermediate portion thereof. The support shaft 17 passes through an elongated hole 14 of an arc-shape formed at an intermediate portion of the operating lever 12. The elongated hole 14 is provided such that the support shaft 17 does not prevent the operating lever 12 from turning right and left.

Figure 4:
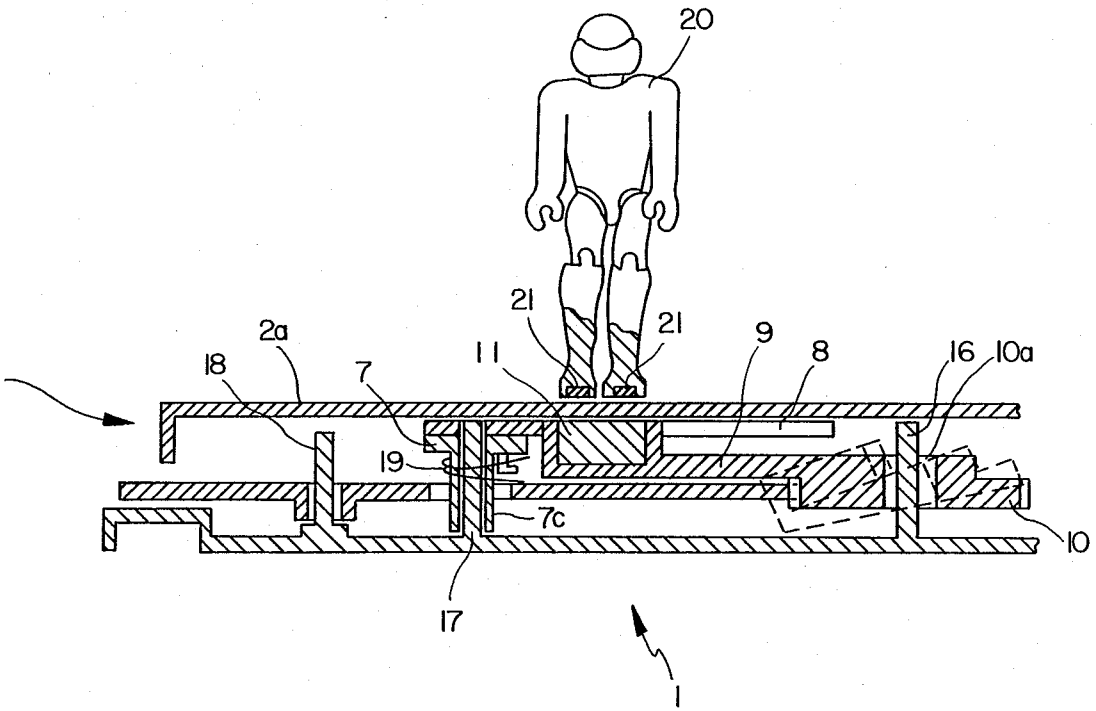
FIG. 4 is a longitudinal sectional view of the base.

As best seen in FIG. 4, in the opening and closing mechanism for doors having the foregoing structure, when the doll 20 is not placed on the base plate 2*a* outside the doors 4, 5, the rotary lever 9 is lowered on the side facing the operating lever 12 by the weight of the rotary lever 9 shown by the chain line. The gear 10 is then out of engagement with a rack 15*a* formed at an arc-shaped section 15 of the operating lever 12 so that the doors 4, 5 are not operated to open and close even by operating the operating lever 12.

Figure 5:
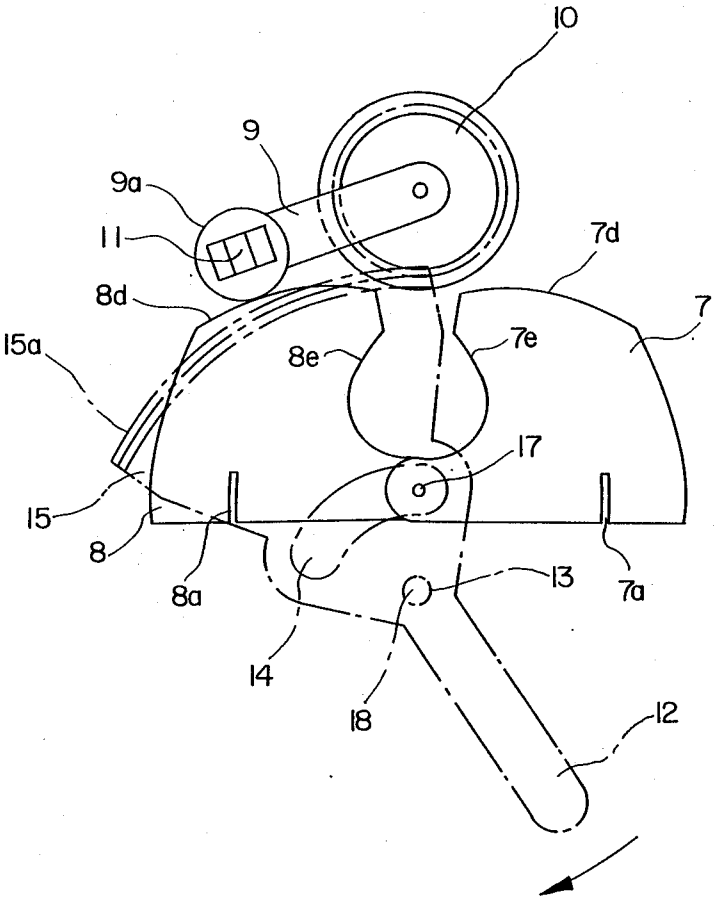
FIG. 5, FIG. 6 and FIG. 7 are plan views showing various operating states of the mechanism.
Figure 6:
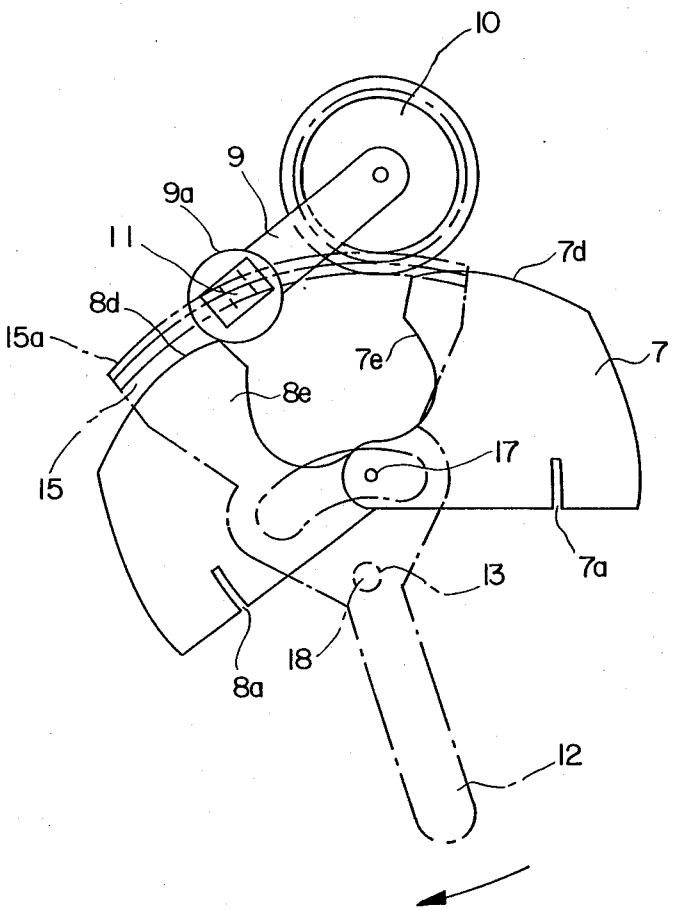
Figure 7:
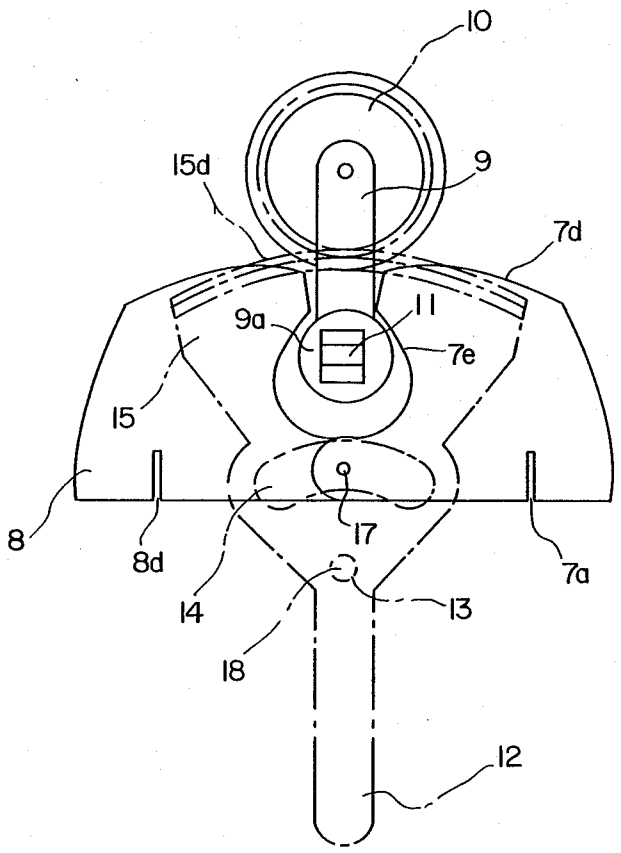

On the other hand, when the doll 20 is placed on the base plate 2*a* outside the doors 4, 5, the tip of the rotary lever 9 is moved up by the attracting force of the permanent magnets 21 incorporated in the doll 20 so that the outer periphery of the cylindrical portion 9*a* formed at the tip of the rotary lever 9 engages with the outer edge 8*d* of the rotary plate 8 (refer to FIG. 5). When the operating lever 12 is turned in the direction of the arrow in FIG. 5, the gear 10 rotates in the counterclockwise direction to rotate the rotary plate 8, which is engaged with the cylindrical tip portion 9*a* of the rotary lever 9, in the counterclockwise direction in FIG. 5 against the elastic force of the coil spring 19. Simultaneously, the first door 4 is moved away from the opening 3*a*, which is an entrance-and-exit to be opened (refer to FIG. 6). The doll 20 is slidingly moved to the inside of the first door 4, being attracted to the base plate 2*a* by the attracting force between the permanent magnets 21 incorporated in the doll 20 and the magnetic substance 11, including a permanent magnet, of the rotary lever 9. The outer periphery of the cylindrical tip portion 9*a* of the rotary lever 9, when it is rotated nearly halfway of its stroke, engages with the center edge 8*e* of the rotary plate 8, the rotary plate 8 rotates in the clockwise direction in FIG. 5 so that the first door 4 is closed when the cylindrical tip portion 9*a* of the rotary lever 9 is between the pair of rotary plates 8 and 7 (refer to FIG. 7). In this state, the doll 20 is positioned inside the first door 4 with the first door and the second door 5 being closed to present a seemingly airtight condition. By continuing the operation of the operating lever 12, the outer periphery of the cylindrical tip portion 9*a* of the rotary lever 9 engages the center edge 7*e* of the rotary plate 7 to rotate the rotary plate 7 in the clockwise direction in FIG. 7 so that the second door 5 is opened. Subsequently, the cylindrical portion 9*a* engages the outer edge 7*d* to close the second door 5 gradually so that the doll 20 can enter the station from the airlock.

Figure 8:
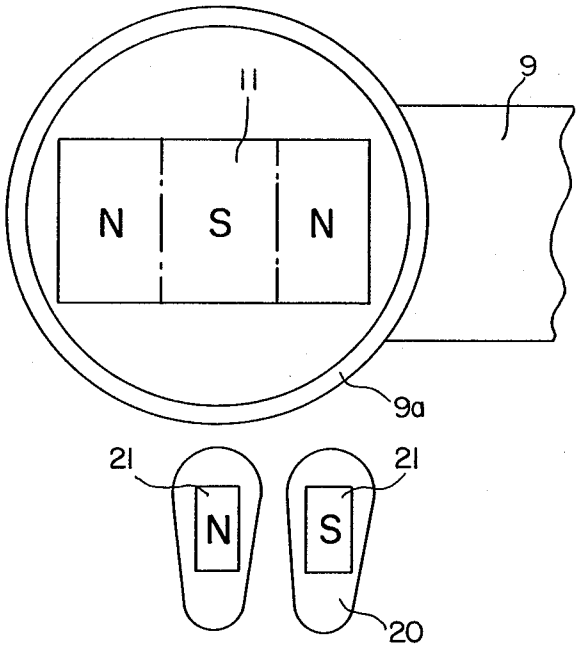
FIG. 8 is an enlarged plan view of the rotary lever and bottom of the doll.

FIG. 8 shows the arrangement of the permanent magnets 21 incorporated at the lower end of the doll 20 and the permanent magnets 11 mounted in the cylindrical tip portion 9*a* of the rotary lever 9. This arrangement is intended to permit the doll 20 to face forward at all times when the doll 20 is operated to go in and out of the doors 4, 5. Specifically, the permanent magnets 21 incorporated at the lower end of the doll 20, i.e., at the feet, are arranged such that one leg shows the south pole and the other shows the north pole. The permanent magnets 11 mounted in the cylindrical tip portion 9*a* of the rotary lever 9 are arranged to show the north pole, the south pole and the north pole along the length of the rotary lever 9. Accordingly, when the doll 20 goes in and out, the doll is advanced facing forward at all times even though the doll slightly moves in the axial direction of the rotary lever 9.

The opening and closing device for doors having the foregoing structure is not operated as long as the doll incorporated therein with the permanent magnet is not placed outside the door. The doll disposed outside the door slides and gets inside in association with the doors being opened and closed by operating the operating lever. Accordingly, the opening and closing mechanism can be provided, which has a wide variety of uses as the opening and closing device of the doors of an airtight space.

I claim:

1. An opening and closing mechanism for double doors for use in a toy and a model, comprising:

(a) a base plate;

(b) a housing mounted on the base plate and formed with two entrance-and-exit openings, said base plate formed near the openings with elongated holes through which lower ends of the doors pass;

(c) first and second rotary plates movably mounted under said base plate, each rotary plate receiving a lower end of one of the doors passing through said elongated holes;

(d) a spring extending between and being mounted to the rotary plates, said spring normally biasing the doors to close the entrance and exit openings;

(e) a rotary lever, movable between a first position toward the base plate, and a second position away from the base plate which is engageable with edges of the rotary plates and provided with first magnetic means at an upper side of a first end thereof and integrally formed with a gear at a second end;

(f) a movable operating lever, having a first end projecting from an opening formed at a side of the base plate, pivoted at a center portion thereof and having an arc-shaped second end with a rack which is engageable with the gear integrally formed with the rotary lever; and (g) a separate doll including second magnet means thereon, wherein, when the doll is not placed on the base plate near the rotary lever, the rotary lever is in the first position and the operating lever does not operate to open and close the doors and, when the doll is placed above on the base plate, near the rotary lever, the first magnetic means of the rotary lever is attracted by the second magnet means of the doll and is caused to move upward into the second position, thereby engaging the gear with the rack and the first end of the rotary lever with at least one of the rotary plates and allowing the operating lever to operate the doors.

2. The mechanism as recited in claim 1, wherein, when the first end of the rotary lever is moved up by the attracting force of the second magnetic means, a cylindrical portion formed at the first end of the rotary lever engages an outer edge of the first rotary plate and when the first end of the operating lever is turned clockwise, the gear rotates counterclockwise to rotate the first rotary plate, which is engaged with the cylindrical portion of the rotary lever, in the counterclockwise direction against the elastic force of the spring, thereby opening the first door.

3. The mechanism as recited in claim 2, wherein, when the first door opens, the doll is slidingly moved to the inside of the first door, being attracted to the base plate by the attracting force between the first and second magnetic means.

4. The mechanism as recited in claim 3, wherein, when the operating lever is rotated nearly halfway of its stroke, the cylindrical portion of the rotary lever engages a center edge of the first rotary plate, the first rotary plate rotates in the clockwise direction so that the first door is closed, the cylindrical portion is positioned between the first and second rotary plates, and the doll is positioned inside the first door with the first and second doors being closed to present a seemingly airtight condition.

5. The mechanism as recited in claim 4, wherein when the operating lever is rotated clockwise further, the cylindrical portion of the rotary lever engages a center edge of the second rotary plate to rotate the second rotary plate in the clockwise direction so that the second door is opened and the cylindrical portion then engages the outer edge of the second rotary plate to close the second door after the doll exits the housing.

6. The mechanism as recited in claim 1, wherein the first magnetic means is a permanent magnet and the second magnetic means is iron.

7. The mechanism as recited in claim 1, wherein the first magnetic means is iron and the second magnetic means is a permanent magnet.

8. The mechanism as recited in claim 1, wherein the second magnetic means is permanent magnets incorporated in the feet of the doll, including on one foot, the south pole and on the other foot the north pole, and the first magnetic means is permanent magnets arranged to show the north pole, the south pole and the north pole along the length of the rotary lever, wherein when the doll enters and exits the housing, the doll is advanced facing forward.

* * * * *